United States Patent [19]

Steinmann

[11] Patent Number: 4,858,993

[45] Date of Patent: Aug. 22, 1989

[54] WORK CHAIR COMPRISING A SWIVELLING SEAT SHELL

[75] Inventor: Joachim Steinmann, Meersburg, Fed. Rep. of Germany

[73] Assignee: Klober GmbH & Co., Fed. Rep. of Germany

[21] Appl. No.: 234,595

[22] Filed: Aug. 22, 1988

[30] Foreign Application Priority Data

Aug. 20, 1987 [DE] Fed. Rep. of Germany ..... 3727784

[51] Int. Cl.[4] ..... A47C 10/32

[52] U.S. Cl. ..... 297/302; 297/304; 297/328

[58] Field of Search ..... 297/300–302, 297/304, 325–328

[56] References Cited

U.S. PATENT DOCUMENTS 2,516,172 7/1950 Baldwin ..... 297/302 X 3,627,252 12/1971 Yamaguchi ..... 297/328 X 4,533,177 8/1985 Lahone ..... 297/301

4,595,236 6/1986 Rizzoli ..... 297/304 X 4,796,950 1/1989 Mrotz, III et al. ..... 297/302

*Primary Examiner*—Peter R. Brown

[57] ABSTRACT

A work or office chair having a seat shell which is pivotably arranged on a height-adjustable seat carrier, characterized by the seat shell being spring loaded to oppose tilting of the seat shell from a raised position towards a tilted, lower position. The chair includes a fixing arrangement for fixing the chair in specific tilted positions. One improvement is a spring arrangement for supporting the chair and a toggle arrangement coacting with the spring arrangement for opposing tilting of the chair with the springs of the toggle arrangement and the supporting spring coacting to require a substantial force to cause initial tilting then followed by a gradual force to cause tilting.

14 Claims, 6 Drawing Sheets

WORK CHAIR COMPRISING A SWIVELLING SEAT SHELL

BACKGROUND OF THE INVENTION

The present invention is directed to a work or office chair having a seat shell which has a front edge and a rear edge with a back rest portion, means for connecting the seat shell to a seat carrier adjacent the front edge to enable pivoting of the shell relative to the carrier, means acting between the carrier and the shell to oppose pivoting of the shell in a first direction in response to a load being applied on the seat shell, such as by a person sitting therein, means for fixing the shell in different swivel positions including a plurality of blocking elements, and the seat carrier being mounted on a height-adjustable member.

Inclining mechanisms for chairs, particularly work or office chairs, are known and are formed with an involved chair support mechanism in order to meet ergonomic demands. The adjustment of the back rest and the seating surface will occur separate or synchronized by these mechanisms and usually involve tilting of the seat around an axis adjacent the front edge. The mechanisms are mainly designed so that the adjustment cannot occur until the seating surface is loaded with the person and this adjustment then occurs, more or less, suddenly, in accordance with the mass resting on the seating surface. These features of known embodiments of work chairs are considered disadvantageous and are based on the mechanism of the chair itself.

SUMMARY OF THE INVENTION

The object of the present invention is to create a chair mechanism that enables the employment of relatively simple elements and provides a tilt adjustment with optimally smooth transition from one tilt position to another. Another object is to be able to provide a mechanism which can be hidden from view and to completely provide a new appearance to a chair equipped in this fashion.

To accomplish these objects, the present invention is directed to an improvement in a work chair comprising a seat shell having a front edge and a back edge, which is adjacent a back rest that is either a separate or an integral back rest, means for connecting the shell to a height-adjustable seat carrier adjacent the front edge to enable pivoting around a swivel axis approximate the front edge, first means acting between the carrier and the seat shell to oppose pivoting of the shell on the swivel axis in one direction and in response to loading of the shell by a person, and second means for fixing the shell in different swivel position including an arrangement of blocking elements. The improvements are characterized that the first means for opposing movement includes a toggle lever arrangement having a first spring means being positioned between the carrier and seat and a second spring arrangement being positioned between the carrier and seat shell adjacent the back rest of the shell, said toggle arrangement including a first toggle lever and a second toggle lever, said second toggle lever being pivotably connected to the seat shell and having a plunger pin adjacent a free end, said first toggle lever having one end pivotably connected to the seat carrier and the other end pivotably connected to the second toggle lever at a position between the ends thereof, said first spring means acting between the first toggle lever and seat carrier to oppose movement of the toggle arrangement to allow pivoting of the seat shell in said one direction, said second spring arrangement exhibiting a linear spring characteristic for supporting a load applied to the chair, said spring characteristic of the second spring and a spring characteristic of the first spring coacting to form two spring characteristics, with the first characteristic initially providing great force opposing movement of the seat in the first direction followed by a spring characteristic allowing a gentle movement of the seat.

What is, thus, fundamentally achieved with the basic embodiment of the present invention is that, due to the specific arrangement of the spring elements, the characteristics of the two springs are combined with a toggle lever arrangement to provide an especially soft adjustment of the seat shell.

This basic embodiment allows the mechanism to be fully hidden in the seat carrier and it is consequently provided that the first spring element or means is a tension spring connected to a portion of the seat carrier adjacent the front edge of the seat shell and is connected to the first lower toggle lever at a point between the connection of the first toggle lever to the second lever and its connection to the seat shell.

The inventive construction of the second spring element, which essentially supports the seat shell directly vertically at the transition area of the back rest, is that the spring is provided in a two-part spring guide, with the bottom part being mounted for pivoting by a bearing pin on a supporting fork, which is rigidly attached to the seat carrier, and that the upper or head end has a bifurcated or forked flange supporting a shaft having rollers, which, in turn, roll on a curved path formed by slots in the structure of the seat shell. In order to move the second spring between a substantially vertical position to a position extending at an angle, a spindle drive is provided, which allows shifting the upper end of the second spring arrangement relative to a fixed point on the seat shell.

What is achieved with the spindle drive is that the spring element supporting the second spring element can be manually swivelled out of a vertical position into a position extending at an angle to vary the amount of prestressing of the spring forming the second spring arrangement to change its initial spring constant.

What is also critical for a soft tilt adjustment is that the catch element in the form of the plunger pin on the second toggle lever extends through a guide slot of a locking lever, which has a plurality of spaced recesses along the length of the slot. The locking lever is urged against the plunger pin so that the pin will be received in one of the recesses to lock the toggle arrangement at a particular pivot position. Thus, this toggle arrangement will act to hold or fix the seat shell in one of the tilted positions.

Other features and advantages of the present invention will be readily apparent from the following description of the preferred embodiments, the drawings and claims.

DESCRIPTION OF THE PREFERRED EMBODIMENTS

Figure 10:
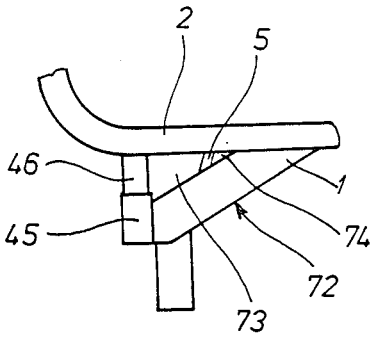
FIG. 10 is a partial silhouette side view of a chair, in accordance with the present invention.

The principles of the present invention are particularly useful when incorporated in a chair mechanism, generally indicated at 72 in FIG. 10 for supporting a seat shell 2. As illustrated, the seat shell 2 is a molded part having a front edge and having a transition for a back rest adjacent a back edge. It should be noted that the seat shell could be formed of a seat which has an individual connection for the back rest.

Figure 1:
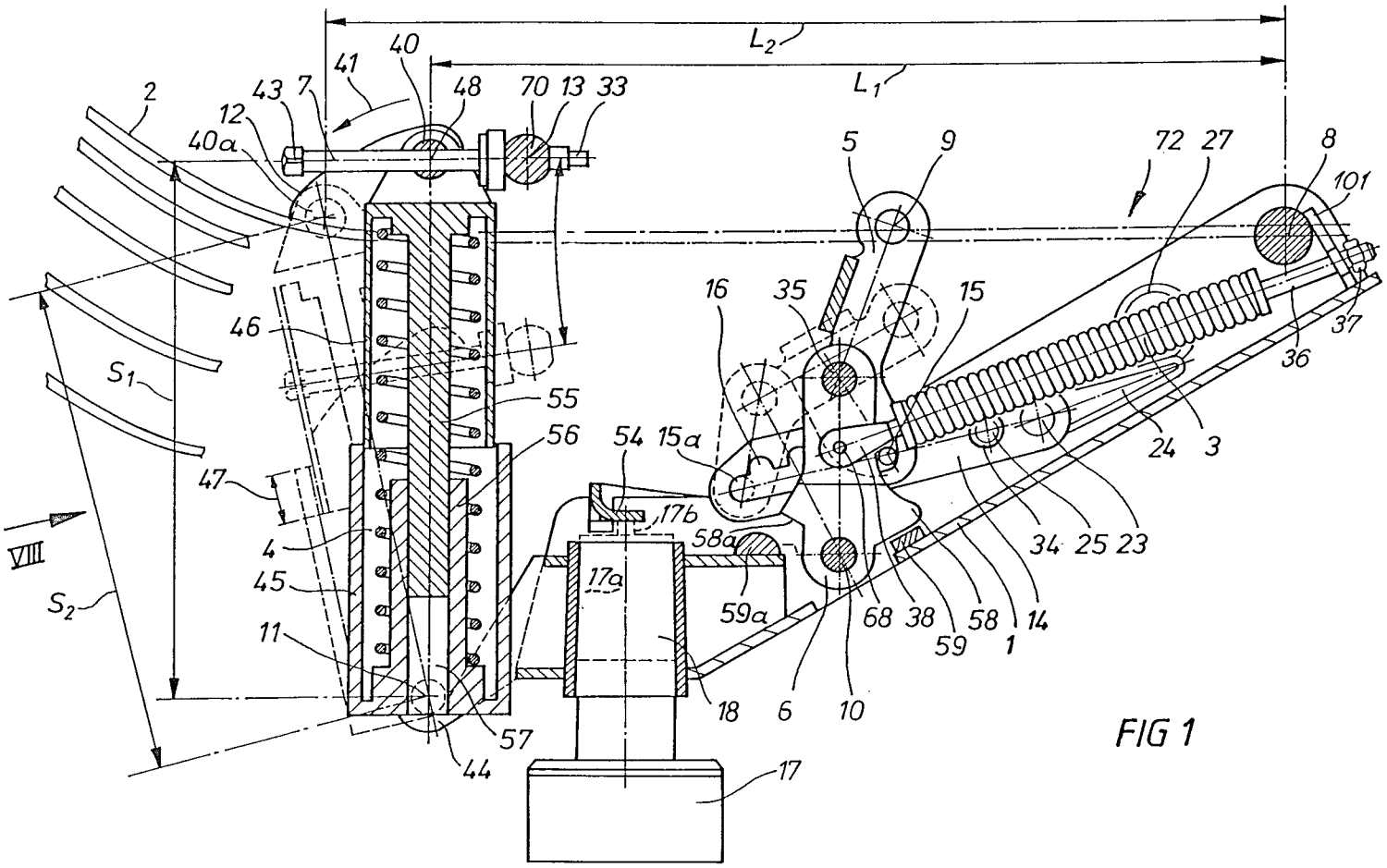
FIG. 1 is a longitudinal cross sectional view taken along the lines I—I of FIG. 2 of the chair mechanism of the present invention.
Figure 2:
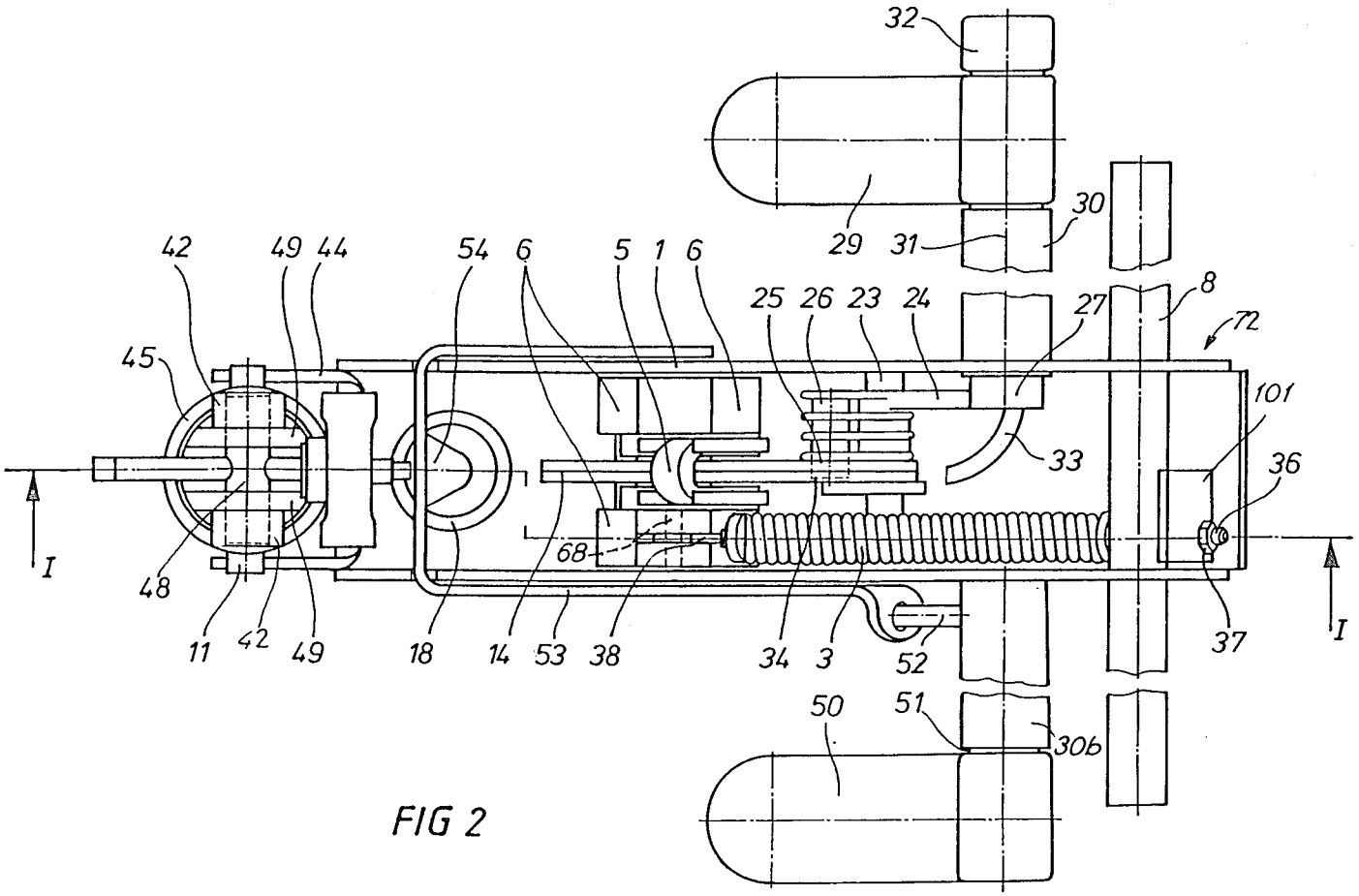
FIG. 2 is a plan view of the chair mechanism of FIG. 1, without the seat shell.

The chair mechanism 72, as best illustrated in FIGS. 1 and 2, is formed by a seat carrier 1, which is a channel-shaped member having a bottom and two side portions. At one end of the carrier 1, a conical receptacle or socket 18 is secured for receiving a stub 17*a* of an elevational unit 17. The elevational unit 17 is a conventional vertical elevator column, which has a pneumatic spring with a valve 17*b* on the upper portion of the stub.

An outer end of the seat carrier 1 supports a shaft 8 that extends through the two sides and is connected to a structure of the seat shell 2 adjacent the front edge to form a swivel connection between the carrier 1 and the shell 2. A back edge or an area adjacent the transition to the back rest is supported by a spring element or arrangement 4 which is illustrated in a vertically extended position and has a lower spring guide 45 provided with a pair of trunnions 11, which are received for pivotal movement on a fork or bifurcated member 44, which is secured to the conical receptacle 18 or to the end of the carrier 1, which is also attached to the receptacle 18. The mechanism 72 also includes a toggle lever arrangement including a bottom, first lever 6 and an upper, second lever 5, as well as a first spring element 3. This toggle lever arrangement is positioned to extend between the carrier and the seat shell at a position approximately midway between the pivot point formed by the shaft 8 and the connection of the second spring means 4.

As illustrated in FIG. 1, the toggle arrangement has a lower first lever 6, which is pivotably connected by a bearing pin 10 to the seat carrier 1 and has cam stops 58 ad 58*a* for engaging stop elements 59 and 59*a*, respectively, on the carrier 1. The stop or shoulder 58*a* engages a stop 59*a* to limit movement around the shaft 10 in a counterclockwise direction. The stops 59 and 59*a* can be formed of an elastic material, such as rubber or a felt material to dampen impact on contact.

The first spring element 3 is a tension spring and extends between the lower first lever 6 of the toggle lever arrangement and an outermost end of the seat carrier 1. One end of the spring has an extension 38 having an aperture receiving a pin 68, which is connected to the first lever 6. As illustrated in FIG. 2, the first lever 6 has a bifurcated portion for receiving the extension 38 with the pin 68 engaged into the portions of the lever. The opposite end of the spring 6 has a stop pin 36, which is anchored to a stop plate 101 of the carrier 1. As illustrated, the stop pin 36 has a nut 37 for completing the anchoring arrangement.

The upper second lever 5 has an upper end which is mounted by a pin 9 into a structure of the seat shell 2. The lever 5, as illustrated in broken lines in FIG. 1 and in bold lines in FIG. 11, has two portions which merge at a bore which receives a pivot pin 35 that forms a connection with the free end of the first lever 6. The portion extending beyond the pivot pin has a plunger pin 15 which coacts with a locking lever 14 which has one end mounted for pivotal movement on a shaft or pin 23 in the carrier 1.

Figure 4:
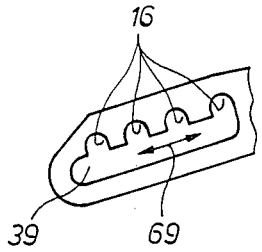
FIG. 4 is a partial side view of the locking lever showing the guide slot with the catch recesses.
Figure 3A:
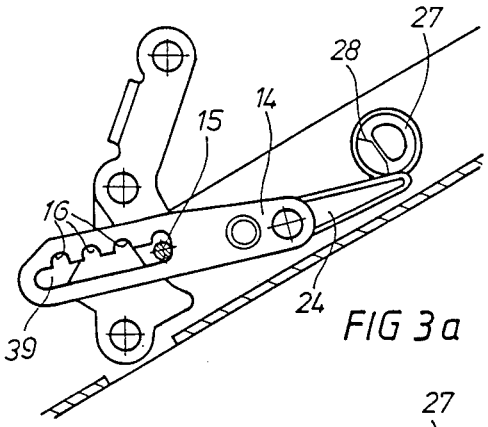
FIG. 3*a* and 3*b* are partial side views of the locking mechanism, with FIG. 3*a* showing the locking mechanism being in a disengaged position, and FIG. 3*b* showing it in an engaged position.
Figure 3B:
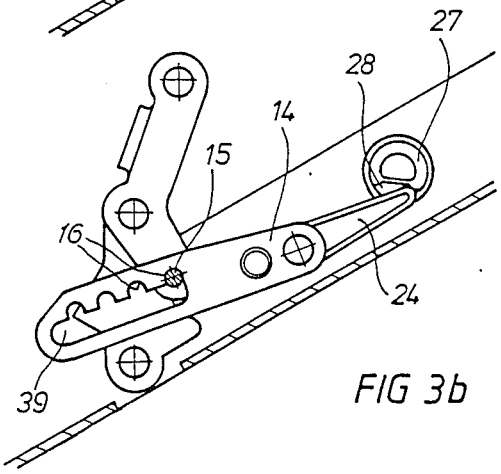

As illustrated in FIGS. 3*a*, 3*b* and 4, the locking lever 14 has an elongated slot 39 with a plurality of spaced recesses 16. The pin 15 extends into the slot 39 and is received in one of the recesses to lock the toggle arrangement in a given angular position. The movement of the locking lever 14 is controlled by a locking arrangement which includes a shaft 27 (FIGS. 2, 3*a* and 3*b*), which is mounted for rotation in a tube 30 that extends from one of the side members of the carrier 1. One end of the shaft 27 is connected to a locking key or handle 29. The other end, as illustrated in FIGS. 3*a* and 3*b*, extends into the channel portion of the carrier and has a recess 28. A second locking lever 24 is mounted for pivotal movement on the shaft 23 and is urged by a spring into contact with the pin 27 so that when the pin 27 is rotated between the position illustrated in FIG. 3*a* to the position illustrated in FIG. 3*b*, the tip of the lever 24 can enter into the recess 28. The lever 24, as illustrated in FIG. 2, is a plastic part that has an offset portion 26 formed as a plurality of ribs that support a dog pin 25 which extends into a recess 34 (FIGS. 1 and 2) of the lever 14. Thus, when the second lever 24 moves from the position illustrated in FIG. 3*a* to the position illustrated in FIG. 3*b*, the lever 14 will be pivoted in a counterclockwise direction on the shaft 23. This causes the pin 15 to move from a disengaged position relative to the recesses 16 to an engaged position. The shaft 27 normally is urged towards the position illustrated in FIG. 3*b* and is moved to the position illustrated in FIG. 3*a* by actuation or movement of the handle 29. Thus, the pin 15 is normally received in one of the plurality of recesses 16 to lock the toggles in a particular angular relationship. Upon actuation of the handle 29, the lever 14 will be shifted to the position illustrated in FIG. 3*a* to disengage the pin 15 from the recess 16 and allow movement in the slot 39 in the direction of the arrow 69 (FIG. 4). This movement from the position illustrated in FIG. 3*a* towards a maximum tilted position, illustrated in broken lines in FIGS. 1, and in full lines in FIG. 11, will be opposed by the tension spring 3, as well as the spring arrangement 4.

As illustrated in FIGS. 1 and 2, the seat carrier 1 has the conical receptacle 18 for receiving the elevator unit 17. A U-shaped rocking lever 53 is mounted on the outside of the carrier or channel member 1, preferably by being pivotably connected on the shaft 10, which extends through the sides of the carrier 1. A bight portion of the lever 53 has a projection or cam 54 which will engage the valve 17*b*for the pneumatic spring. One of the arms of the lever 53 is connected by a pin or bolt 52, which (see FIG. 8) extends through a slot 30*a* in a tube 30*b* and is connected to a shaft 51. The shaft 51, which is rotated in the tube 30*b* that extends from one of the sides of the channel forming the carrier 1, has an actuation handle or key 50. Thus, by actuating the handle 50, the shaft is rotated to pivot the lever 53 to cause the projection 54 to actuate or open the valve 17*b* to release air from the pneumatic spring to adjust the height of the carrier and a seat shell from the floor.

Figure 11:
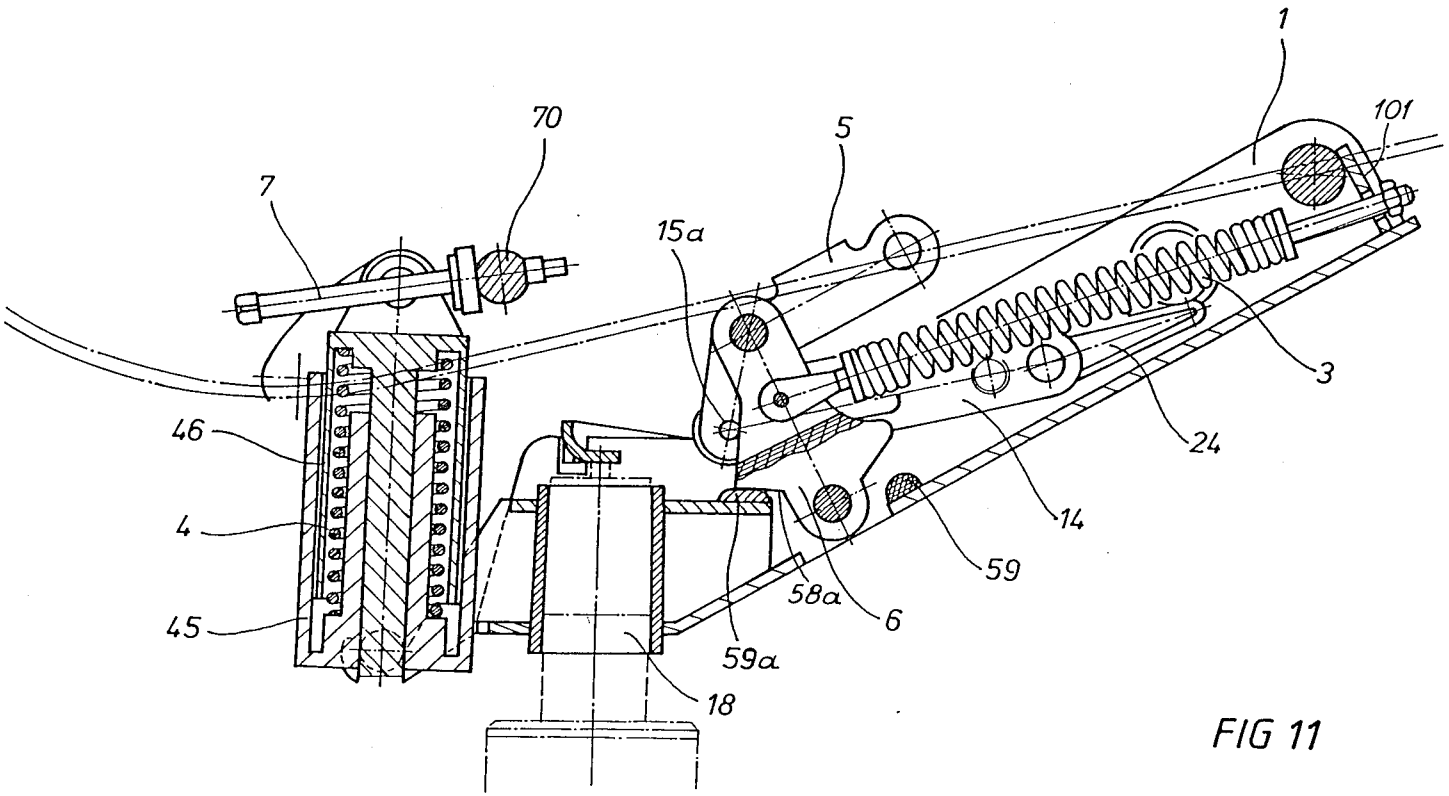
FIG. 11 is a cross sectional view similar to FIG. 1 of the chair, in accordance with the present invention, with the seat shell in its lowermost position.

The spring element 4 supports the rear portion of the seat shell 2 and has, as mentioned above, the lower part 45 of a spring guide with a pair of trunnions 11 that are received on the bifurcated element or fork 44 (see FIG. 2). The lower spring guide 45 has an inner guide sleeve 56 (FIG. 1) which has a central bore 57. The spring element 4, which is a helical compression spring, is telescopically received onto this guide sleeve 56. An upper spring guide 46 has an inner guide pilot or shaft 55, which is received in the central bore 57 and is freely displaceable therein so that the upper part is telescopically received into the lower part 45 as the spring 5 is compressed. The central bore 57 extends through the bottom of the part 45 so that when the arrangement is in its most compressed condition, as illustrated in FIG. 11, the end of the shaft 55 will extend out of the opening, as illustrated.

As already explained and as may be seen from the FIGS. of the drawings, the entire basic load spring element 4, comprising the upper and lower guides 46, 45, is pivotable on the fork member 44 due to the trunnions 11 and the entire arrangement can roll on a portion of the seat shell 2. The upper spring guide 46 has a bifurcated or forked flange 49 which has a shaft or axle 48, which, as illustrated in FIG. 2, supports two rollers 42, 42. Each of the rollers 42, 42 rolls on a circular path 12, which is formed in a recess or slot 43 of the support structure for the seat shell 2. The overall arrangement of the spring element 4, together with the support of the seat shell 2 via the roller arrangement, enables an adjustment of the spring attack point of the spring element 4 on the seat shell 2 and interrelates thereto the extremely simple adaptation to different users weights.

Figure 8:
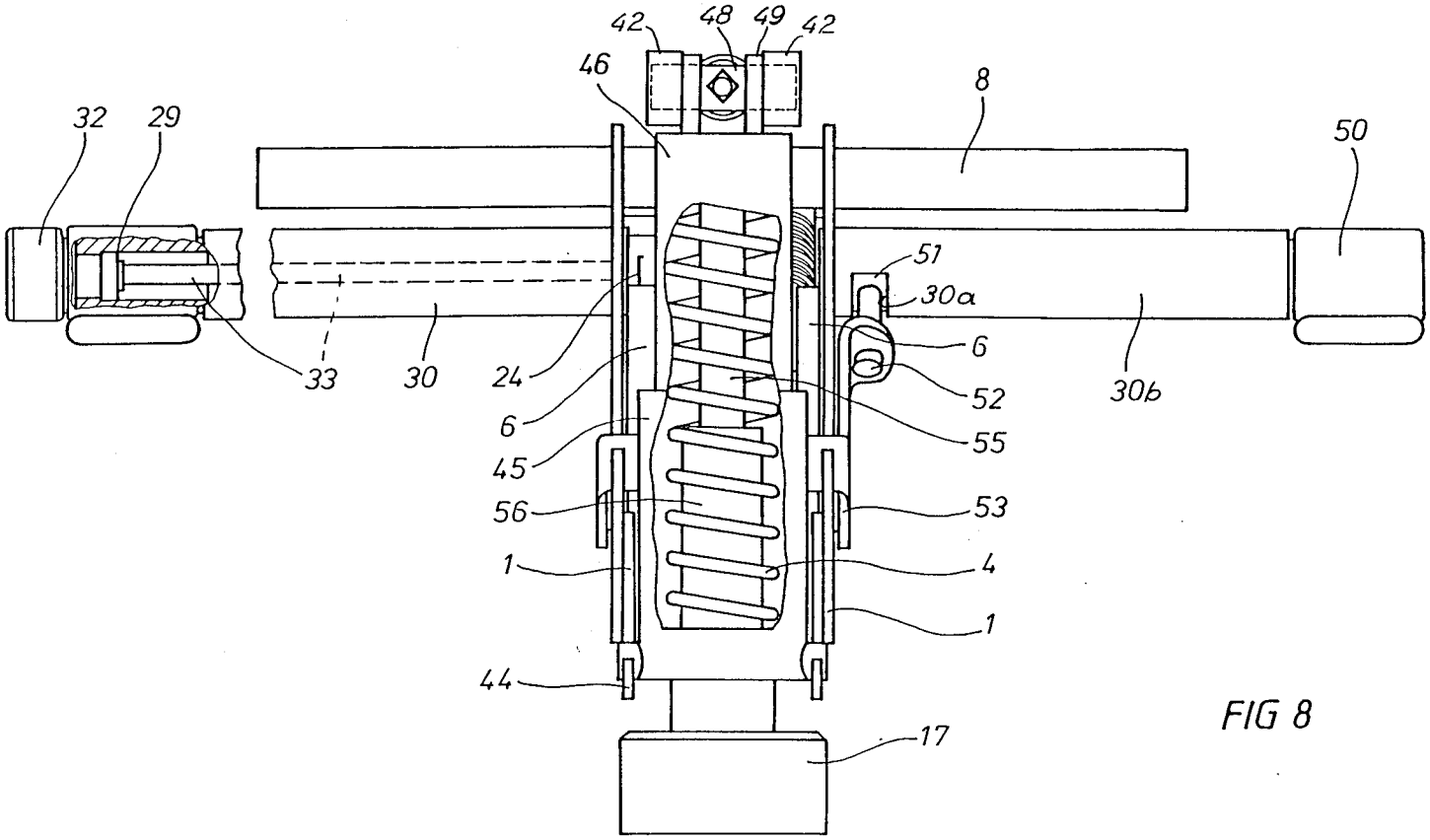
FIG. 8 is an end view with portions broken away taken from the direction of arrow VIII of FIG. 1.
Figure 9:
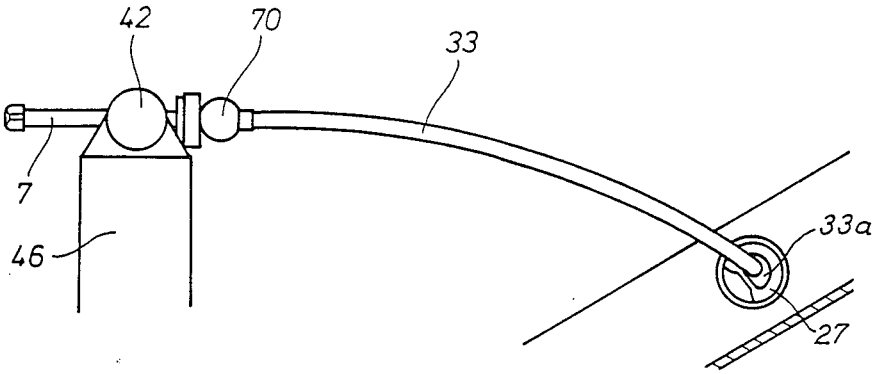
FIG. 9 is a partial view showing the relationship of a flexible shaft for a spindle drive, in accordance with the present invention.

An actuation arrangement for shifting the roller arrangement on the path 12 includes an actuation chain which has a flexible shaft 33 that is provided for the adjustment of the position of the operation element. To accomplish this, the shaft 48 has a threaded bore to form a spindle nut 40, which is threadably received on a spindle 7. The spindle 7 is rigidly connected to a flexible shaft 33 and adjacent at an abuttment or connector 70, which provides a fixed relative position to the structure of the seat shell 2, The flexible shaft 33 extends, as illustrated by the broken portions in FIG. 2 and as illustrated in FIG. 9, towards the front edge and extends through a bore 33*a* in the shaft 27, which is mounted in the tube element 30. The end of the shaft 33, as shown in FIG. 8, terminates in a weight adjustment knob 32 which extends out the end of the tube 30 adjacent the adjustment handle 29. Since the knob 32 is torsionally connected to the flexible shaft 33, a turning of the knob will rotate the shaft and cause the spindle nut 40 to move along the axis of the spindle 7 to have the rollers move in the direction of the arrow 41 on the curved path 12. Thus, the spring arrangement 4 can be pivoted from the position, illustrated in bold lines in FIG. 1, to a position 40*a*, shown in broken lines in FIG. 1. Such a movement causes a compression of the spring.

When the spindle nut 40 is in the vertical position, as illustrated in bold lines in FIG. 1, an effective lever arm $L_1$ is the horizontal distance between the center of the shaft 8 and the center of the shaft or pin 48. A vertical distance $S_1$ between the axis of the trunnions 11 and the shaft 48 occurs. By shifting the spindle nut to the position 40*a*, shown in broken lines, the effective lever arms is increased to $L_2$ and the vertical distance is compressed to the distance $S_2$. The amount of this compression is shown by a double arrow 47. With the arrangement illustrated, the lever arm can now be changed from $L_1$ to $L_2$ by actuating the spindle arrangement. It is also critical that, for the swing-out of the seat shell 2, the spring power of the spring element 4 is simultaneously increased, namely in that the spring is pretensioned more simultaneously given the adjustment of the spring 4 via the spindle 7. This is effective in that the roller assembly 42 can roll in the region of the curved path 12. It is important that the curved path 12 is eccentric in the direction with reference to the lower bearing formed by the trunnions 11 so that when the assembly 4 is pivoted towards the back in the arrow direction 41 by the spindle arrangement, the rollers move on a curved region that causes a compression of the spring 4 to a greater degree, namely by the displacement path 47.

A critical advantage is, thus, achieved that the spring power can be adjusted simultaneously with the spindle position adjustment and the supporting power of the spring element 4 is disproportionally changed for a relative slight range of adjustments that is prescribed by the spindle length. In other words, the entire spring arrangement is supported in a region of the seat shell 2 that is displaced towards the back on the one hand, and, on the other hand, the spring 4 is increasingly pretensioned, thereby doubling the effect that occurs.

Figure 5:
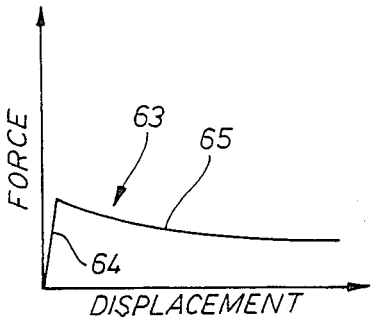
FIG. 5 is a graph showing the support or spring force versus spring displacement for a spring element acting on the toggle arrangement, in accordance with the present invention.
Figure 6:
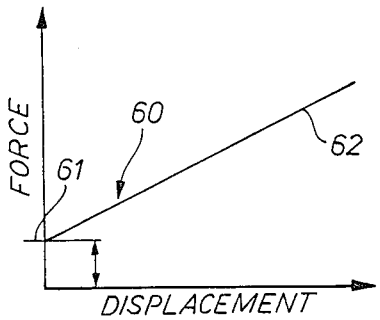
FIG. 6 is a graph showing the relationship of the supporting or spring force characteristics against spring displacement for the spring supporting the basic load, in accordance with the present invention.
Figure 7:
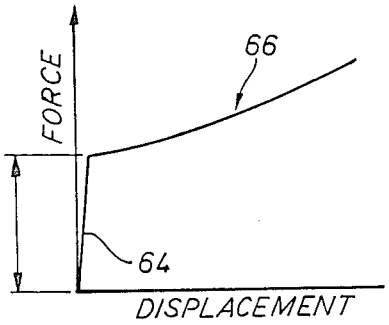
FIG. 7 is a graph showing the combined characteristics of the two springs.

As graphically illustrated in FIGS. 5, 6 and 7, the various spring relationships are provided. In each of these Figures the spring force or supporting force F is applied against the amount of the spring displacement. In FIG. 5, a spring characteristic for the spring 3 is illustrated, whereas FIG. 6 shows the spring characteristic for the spring 4.

According to FIG. 6, the spring characteristic of the spring 4 is linear, as shown by a curve 60. The spring 4 is, thereby, prestressed so that the spring forces at zero displacement have a value at a point 61. This graph is constructed without the effect of the spring 3. The spring characteristic of the curve 60 is a linear curve up to the point 62. However this has the disadvantage that a far too fast downward swivelling or pivoting will result therefrom, given the stressing of the shell with the body of the user. Even given a slight displacement of weight towards the back, the user would immediately tilt the seat shell with this type of spring arrangement, which is undesirable.

In order to avoid this undesirable situation a nonlinear curve 63, according to the spring characteristics of the spring 3, is provided, As illustrated in FIG. 5, the spring 3, which is hinged to the lower toggle lever 6 of the toggle arrangement 5 and 6, provide a different characteristic, which can be shown by the curve 63. The curve 63 has a first section or portion 64 that rises rather steeply with reference to the spring excursion, and then shallowly emerges into a relatively straight curve section 65. When the spring characteristic of the spring 3, as illustrated in FIG. 5, is added to and superimposed on the spring characteristic of the spring 4 with the other elements, a curve, such as 66 illustrated in FIG. 7 will occur. This curve 66 has a first portion 64 that has a relatively steep rise in the force of a small amount of displacement for the springs, and this means that the user initially exerts a relatively great force in order to pivot or tilt the seat shell out of its resting position but, after overcoming this steep curve portion 64, which occurs only through a short or slight pivot path, the curve then reaches a soft curve section, which has a gentle swinging for the seat shell to being.

Special spring characteristics or swinging characteristics for the seat shell are, thus, achieved with a relatively cost-beneficial mechanism, as may also be seen in detail from the Figures of the drawing.

In FIG. 1, the upper position for the seat shell 2 is illustrated for all of the parts. In the dash lines, the position of the toggle arrangement is illustrated for the lowermost or most tilted position, which is shown in bold lines in FIG. 11. It should be noted that for the position illustrated in FIG. 11, the stop 59*a* is contacted by the shoulder 58*a* and the locker lever 14 is in the raised, disengaged position so that the pin 15 assumes the position 15*a*, which does not prevent any locking. Thus, once a pivoting in an upward or clockwise direction starts, it is possible to move to the upper position or, if the lever is released for the locking bar to move into the first recess 16 of the slot 39.

As mentioned earlier, FIG. 10 shows a partial side view of the chair of the present invention, which chair has a visually improved or enhanced structure because of the compact chair or support mechanism 72 of the invention, which allows only a few of the elements to be visible. The chair mechanism 72 has only the carrier 1 visible, along with the spring guides 45 and 46 adjacent the back portion of the carrier 1. Also, only the upper toggle lever 5 projecting above the carrier 4 is seen so that there are open regions or spaces 73 and 74 extending between the seat shell 2 and the seat carrier 1. Thus, this leads to a completely new visual presentation.

Even though this invention fundamentally proceeds on the basis of a one-piece seat shell, it is also possible that the seat is pivotable on the swivel axis 8 in the same fashion and the seat carrier supports a back rest on a swivel axis or a seat carrier separate from the seat itself. A point-synchronized mechanism for transmitting swivel movement onto this separate back rest part or some other suitable transmission elements are then utilized with minor modifications.

While FIGS. 2 and 8 show the shaft 8 and the tube 30, 30*b* as separate elements, it is possible to position the tubes 30 and 30*b* at the location of the shaft 8 and use the tubes 30 and 30*b* to form the pivot connection with the seat shell 2.

Although various minor modifications may be suggested by those versed in the art, it should be understood that I wish to embody within the scope of the patent granted hereon all such modifications as reasonably and properly come within the scope of my contribution to the art.

I claim:

1. In a work chair comprising a seat shell having a front edge and a back portion adjacent a back rest, means for pivotably connecting the shell to a height adjustable seat carrier adjacent the front edge to pivot on a swivel axis, first means positioned between the carrier and the seat shell to oppose pivoting of the seat shell on the swivel axis in one direction in response to a person sitting on the seat shell, and means for fixing the seat shell in different angular positions which includes an arrangement of blocking elements, the improvements comprising the first means for opposing the pivotable movement including a toggle arrangement having a first spring element, and a separate second spring element, said toggle arrangement including a first toggle lever pivotably connected at one end to the seat carrier and pivotably connected to a second toggle lever at a point spaced inward of the ends of the second toggle lever, said second toggle lever having one end pivotably connected to a support structure of the seat shell, said first spring element acting between the first toggle lever and the seat carrier to oppose pivoting of the first toggle lever during pivoting of the seat shell in said one direction, said second spring element supporting a base load and being positioned at the end of the seat carrier to act between a portion of the seat shell adjacent the back portion and said carrier, the spring characteristics for the second spring element and the first spring element being selected to form a compound spring motion providing an initially stiff force against pivoting followed by a soft suspension so that initial pivoting from an upper position towards a lower tilted position requires an initially large increase in the amount of force which is followed by a rather small increase in the amount of force.

2. In a chair according to claim 1, wherein the first spring element is a tension spring element having one end connected to a spring receptacle having a pin pivotably connected to the first toggle lever and the opposite end being anchored on the spring carrier, said first spring element, due to the position on the toggle lever has a non-linear spring curve.

3. In a chair according to claim 2, wherein the means for fixing the shell includes a first locking lever mounted for pivotal movement on a shaft provided on the seat carrier, said locking lever having a slot having catch recesses along one side thereof, said slot receiving a pin attached to a free end of the second toggle lever and means for moving the locking lever from a first position releasing the pin from the recesses to a second position with the pin being engaged in one of the recesses to define an angular position between the two toggle levers of the toggle arrangement.

4. In a chair according to claim 3, wherein the first locking lever is shifted between the two positions by a second locking lever pivotably mounted on said shaft, said second locking lever having a dog pin on one end engaged with the first locking lever so that pivoting on the second locking lever pivots the first locking lever, said second locking lever being urged into contact with an actuation shaft, said actuating shaft having a recess so that during rotation of said actuation shaft, said second locking lever is pivoted to shift the first lever between said first and second positions.

5. In a chair according to claim 2, wherein the second spring element is received in a two-part spring guide, with the lower part being mounted by bearing pins for pivotable movement relative to the seat carrier, the upper part having a pair of flanges receiving a roller shaft having rollers thereon, said rollers engaging a curved path provided on a structure for said seat shell, a spindle drive for shifting the two-part spring guides and second spring element from a substantially vertical position to a slanting position to cause said rollers to move on said roller path, said slanting position causing a compression of the second spring element and said spindle drive including a spindle nut coupled to the upper housing part and threadably received on a threaded spindle and an arrangement for rotating said spindle shaft to shift the nut therealong.

6. In a chair according to claim 1, wherein the second toggle lever has its end connected to the seat shell roughly in a position halfway between the swivel axis for the seat shell and a supporting area engaged by the second spring element, the first toggle lever has its end pivotably connected to the carrier by a bearing pin, which further supports a U-shaped rocker lever having one leg providing a projection for actuating a valve of a pneumatic elevator unit attached to the seat carrier.

7. In a chair according to claim 1, wherein the seat carrier is a channel member having a U-shaped cross section, a tubular element extending from each side of said channel member at right angles thereto, one of said tubular elements receiving a first actuation shaft having a bore, said first actuation shaft being connected to an actuation handle for rotation in said one tube, said bore receiving a flexible shaft extending through the actuation shaft to a weight-adjustment knob disposed on the end of said actuation shaft outward of said actuation handle, said shaft and handle being a portion of the fixing means for locking the seat shell in one of the adjusted tilt positions, the other of said tubes receiving a second actuation shaft having a second actuation handle, said second actuation shaft being connected to a rocker lever coupled to the shell carrier, the rocker lever having a projection for actuating a control element of an elevator unit for said chair.

8. In a chair according to claim 7, wherein the tubular elements attached to the seat carrier form a portion of the front bearing shaft for the pivotable connection of the seat shell adjacent the front edge of the seat carrier.

9. In a chair according to claim 7, wherein the tubular elements are concentrically arranged on said element.

10. In a chair according to claim 7, wherein the fixing arrangement includes a first locking lever having a slot with recesses for receiving a pin on the second toggle lever, said first locking lever being mounted for pivotable movement on a bearing shaft, a second locking lever mounted for pivotable movement on said shaft and having a dog engaging said first locking lever, said second locking lever being urged against said first actuation shaft, said first actuation shaft having said bore having a recess thereon so that rotation of said first actuation shaft causes said second locking lever to be pivoted on said bearing shaft to pivot the first locking lever between a first position with the recesses engaging the pin of the second toggle lever to lock the toggle arrangement in a fixed angular relationship and a second position with the pin being free of said recesses to allow changing the angular position of the toggle levers.

11. In a chair according to claim 1, wherein the first toggle lever has a pair of shoulders engaging stops to limit the maximum pivoting from one position counterclockwise to a second position, at least one of said stops being a flexible stop to provide a dampening impact of said movement.

12. In a chair according to claim 1, wherein the seat shell is a one-piece seat shell having an integral back rest and seat.

13. In a chair according to claim 1, wherein the second spring element has a two-part spring guide, one of said parts being pivotably mounted adjacent the bottom on a supporting fork rigidy connected to the seat carrier and the other of said parts having a roller shaft supporting a roller for engaging a curved track on the support structure of said seat shell, a spindle drive for shifting the second spring arrangement between a substantially vertical orientation and a slanted orientation, said slanted orientation causing partial compression of said second spring to change the spring characteristics of the second spring element.

14. In a chair according to claim 1, wherein the means for fixing the shell in different swivel positions include a shaft mounted for rotation in said seat carrier, said shaft having an acutation handle and, at an end adjacent said carrier, having a recess, a first locking element being mounted on a bearing pin mounted on said carrier and having an elongated slot with a plurality of spaced recesses, said slot engaging a plunger pin of the second toggle lever, a second locking element mounted on said bearing pin in the carrier and having one end urged against the surface of said shaft and the other end connected by a dog to the first locking lever so that as the shaft of the fixing means rotates to cause pivoting of the second locking lever, said first locking lever is shifted between a first position with the plunger pin engaged in one of the recesses to a second position with the plunger pin disengaged from the recesses and free to move along said elongated slot.

* * * * *